US010641034B2

(12) United States Patent
Dong et al.

(10) Patent No.: US 10,641,034 B2
(45) Date of Patent: May 5, 2020

(54) ASSEMBLY FRAME STRUCTURE OF WOODEN CASEMENT WINDOW AND CORNER ASSEMBLY METHOD

(71) Applicant: ZHEJIANG ROOMEYE ENERGY-SAVING TECHNOLOGY CO., LTD., Zhejiang (CN)

(72) Inventors: Chengming Dong, Zhejiang (CN); Lijiao Yin, Zhejiang (CN); Weixing Wu, Zhejiang (CN); Yibin Jiang, Zhejiang (CN); Zhixiang Xu, Zhejiang (CN); Haihua Xu, Zhejiang (CN); Linjie Pan, Zhejiang (CN); Jun Huang, Zhejiang (CN)

(73) Assignee: ZHEJIANG ROOMEYE ENERGY-SAVING TECHNOLOGY CO., LTD., Zhejiang (CN)

( * ) Notice: Subject to any disclaimer, the term of this patent is extended or adjusted under 35 U.S.C. 154(b) by 21 days.

(21) Appl. No.: 15/756,989

(22) PCT Filed: Nov. 20, 2015

(86) PCT No.: PCT/CN2015/095095

§ 371 (c)(1),
(2) Date: Jun. 21, 2018

(87) PCT Pub. No.: WO2017/035957

PCT Pub. Date: Mar. 9, 2017

(65) Prior Publication Data

US 2018/0283088 A1 Oct. 4, 2018

(30) Foreign Application Priority Data

Sep. 2, 2015 (CN) ..... 2015 1 0553825
Sep. 2, 2015 (CN) ..... 2015 2 0675439 U

(51) Int. Cl.
*E06B 3/984* (2006.01)
*E06B 1/04* (2006.01)

(52) U.S. Cl.
CPC ..... *E06B 3/9845* (2013.01)

(58) Field of Classification Search
CPC ..... E06B 3/9845
(Continued)

(56) References Cited

U.S. PATENT DOCUMENTS 4,067,161 A * 1/1978 Rensch ..... A47B 47/04 312/139.2
4,069,641 A * 1/1978 Dezutter ..... E06B 3/28 52/202

(Continued)

FOREIGN PATENT DOCUMENTS

CN 101260772 A * 9/2008
CN 101260772 A 9/2008

(Continued)

OTHER PUBLICATIONS

"Wu CN101260772 (A)—45 degree tenon joint board for wood door and window perpendicular connection angle" CN101260772A+ transl bib desc clm.pdf (Year: 2019).*

(Continued)

*Primary Examiner* — Patrick J Maestri
*Assistant Examiner* — Joseph J. Sadlon
(74) *Attorney, Agent, or Firm* — Gang Yu

(57) ABSTRACT

Disclosed are a frame assembly structure of a wooden doors and windows and a corner assembly method. The window includes, at least, a window frame or a casement window frame mainly formed by joining adjacent profile frame strips via a corner assembler on adjacent connecting end surfaces. The connecting end surfaces of two adjacent profile frame strips are respectively configured to be cross sections of 0°

(Continued)

to 180°. A positioning notch of the corner assembler is at least provided on the cross sections. Two half corner assemblers of the corner assemblers are respectively embedded and fixed into the positioning notches on the adjacent cross sections. The two half corner assemblers are connected by an intermediate fastening piece and a fastening bolt to form a complete corner assembler, and the two adjacent profile frame strips are connected tightly and fixedly. The frame assembly structure is easy to assemble.

4 Claims, 3 Drawing Sheets

(58) Field of Classification Search
USPC ..... 52/204.5
See application file for complete search history.

(56) References Cited

U.S. PATENT DOCUMENTS 4,207,707 A * 6/1980 Holdiman ..... E06B 3/302 49/501
4,352,588 A * 10/1982 Davies ..... B23Q 35/104 144/144.1
4,740,098 A * 4/1988 Witt ..... E06B 3/984 403/205
5,737,890 A * 4/1998 Heyden ..... E06B 3/984 52/455
6,076,314 A * 6/2000 Simonton ..... E06B 3/44 49/504
6,125,604 A 10/2000 Holmes
6,606,832 B2 * 8/2003 Richardson ..... A47F 3/0434 312/116
7,036,280 B2 * 5/2006 Hogan ..... E04B 2/96 52/204.5
8,347,566 B2 * 1/2013 Knapp ..... E04B 2/965 52/204.5
8,490,347 B2 * 7/2013 Valler ..... E06B 3/16 52/204.1
8,813,442 B1 * 8/2014 Edwards ..... E06B 3/5892 52/204.5
8,984,821 B2 * 3/2015 Bruno ..... E06B 3/72 52/210
9,234,383 B2 * 1/2016 Bruno ..... E06B 3/74
9,322,209 B1 * 4/2016 Schwind ..... E06B 3/28
9,500,023 B2 * 11/2016 Poniros ..... E06B 1/04
9,593,526 B2 * 3/2017 Wang Chen ..... E06B 3/5892
2004/0172895 A1 * 9/2004 Plummer ..... E06B 3/685 52/204.5
2005/0235596 A1 * 10/2005 Pegorado ..... E06B 3/9642 52/656.9
2006/0096193 A1 * 5/2006 Ohrstrom ..... E06B 3/22 52/204.5
2007/0297854 A1 * 12/2007 Ohrstrom ..... E06B 3/9647 403/401
2011/0138716 A1 * 6/2011 Schulte ..... B60J 10/30 52/208

FOREIGN PATENT DOCUMENTS

CN 102182386 A 9/2011
CN 103382804 A 11/2013
CN 204299413 U * 4/2015
CN 204299413 U 4/2015
CN 204343924 U 5/2015
CN 205153906 U 4/2016
DE 1917612 A1 * 11/1970 ..... E06B 3/984
DE 10245171 A1 * 4/2004 ..... E06B 3/9845
DE 202010011872 U1 3/2011
EP 0235039 A1 9/1987
GB 2511163 A 8/2014
WO WO-0127428 A1 * 4/2001 ..... E06B 3/10
WO 2014122181 A1 8/2014
WO WO-2015063690 A1 * 5/2015 ..... E06B 3/9845

OTHER PUBLICATIONS

"Li CN204299413 (U)—Fixing device used for connecting transverse border with vertical border of square frame" CN204299413U+transl bib desc clm.pdf (Year: 2019).*
USPTO Translation Services, "Translation of CN 101260772 (A)", May 2019, "Translated by: LinguaLinx Language Solutions, Inc. Hedley Park Place, 433 River Street Troy, NY" 9 pages (1 drawing page) (Year: 2019).*

* cited by examiner

ASSEMBLY FRAME STRUCTURE OF WOODEN CASEMENT WINDOW AND CORNER ASSEMBLY METHOD

TECHNICAL FIELD

The disclosure relates to a frame assembly structure of a wooden casement window, and falls within the technical field of building windows.

BACKGROUND

At the present stage, China is strongly advocating a policy of energy conservation and emission reduction, and building energy conservation, serving as an important component in the field of overall energy conservation, plays an important role increasingly. Window energy conservation occupies about 40% to 50% of the building energy conservation, and improvement of the window energy conservation is improvement of the building energy conservation. Due to a better heat preservation performance, a wooden window is widely applied to energy conservation buildings.

A frame assembly mode of a traditional wooden casement window is groove tenon joining, an overall process is complicated, and a fitting precision requirement is high. The quantity of processing devices used in groove tenon processing and corner assembly processes is large, the cost investment is high, and the accuracy is difficult to control. When corners are assembled by using 45°, corner assembly is achieved by using a round tenon rod and dovetail tenon corner assembly process. However, because a dovetail tenon is made of nylon and due to the own structure thereof, the overall strength after corner assembly is unlikely to achieve groove tenon corner assembly strength. Moreover, a phenomenon of non-tight sealing of some joints as time goes by will be caused, thereby generating phenomena of water seepage, mildewing and the like.

SUMMARY

The disclosure is directed to a frame assembly structure of a wooden doors and windows, which is simple in structure, convenient to install, firm to use, and capable of effectively ensuring the joining strength of corners and the corner assembly sealing property, increasing convenience of frame assembly and improving the production efficiency, in order to overcome the defects in the prior art.

The objective of the disclosure is fulfilled by means of the technical solution as follows. According to a frame assembly structure of a wooden doors and windows, the wooden doors and windows comprises, at least, a window frame or a casement window frame mainly formed by joining adjacent profile frame strips via a corner assembler on adjacent connecting end surfaces. The connecting end surfaces of two adjacent profile frame strips are respectively configured to be cross sections of 0° to 180°. A positioning notch of the corner assembler is at least provided on the cross sections of 0° to 180°, and after adjacent profile frame strips are spliced completely, a space for accommodating an assembly-type corner assembler is formed at a spliced joint, wherein one half corner assembler is embedded and fixed into the positioning notch on the cross section of 0° to 180° of a profile frame strip, and the other half corner assembler is embedded and fixed into the positioning notch on the cross section of 0° to 180° of the adjacent profile frame strip. The two half corner assemblers are connected by an I-shaped fastening piece located in an intermediate position of the two half corner assemblers and fastening bolt to form a complete assembly-type corner assembler, and the two adjacent profile frame strips are connected tightly and fixedly.

Preferably, the assembly-type corner assembler is formed by combining two half corner assemblers identical in structure and shape, an I-shaped fastening piece and a fastening bolt. Each of the half corner assemblers is a fixing substrate with a fixing hole, wherein two symmetric side edges of the fixing substrate are vertically provided with a fixing side plate having a buckling edge at an upper end portion, separately, so as to form a plug notch above the fixing substrate, the fastening piece is an I-shaped fastening piece, wherein two symmetric edges of the I-shaped fastening piece just correspond to the plug notches on the fixing substrates, such that side edges of the I-shaped fastening piece are fixedly connected between the two half corner assemblers after being inserted from an end side.

Preferably, an end edge of the fixing substrate is provided with a vertical baffle, a half-round groove is provided at an upper end of the vertical baffle, and a hole allowing the fastening bolt to extend into the assembly-type corner assembler and to screw the I-shaped fastening piece is formed after the two half corner assemblers are connected together, and a screw hole provided on a side end of the I-shaped fastening piece corresponds to the hole, and the screw hole is used for screwing the fastening bolt.

A corner assembly method for a wooden doors and windows comprises the steps as follows.

a) A profile section needing to be corner-assembled is processed to be a cross section of 0° to 180° according to an angle requirement, and a corner assembly installation groove and a round tenon rod hole are milled in corner end surfaces of a corresponding profile;

b) Two half corner assemblers are respectively installed in positioning notches at cross sections of 0° to 180° of adjacent profile frame strips, and are fastened and joined with end surfaces of the profile frame strips by means of a screw fastening piece;

c) A round tenon rod of one of the profile frame strips is coated with an end surface adhesive, and then the round tenon rod is inserted into the round tenon rod hole;

d) During corner assembly, a side edge of an I-shaped fastening piece is inserted into a plug notch of a fixing substrate in a corner assembler of a profile at one side, round tenon rods of two profile frame strips, round tenon rod holes and corner assemblers are calibrated, fastening is performed by means of fastening bolt extending out of holes in vertical baffles of the two half corner assemblers through rotation, and meanwhile, the round tenon rods corresponding to profile corners are positioned and inserted.

The corner assembly method for a wooden doors and windows, in the step a), after the respective cross sections of 0° to 180° of two adjacent profile frame strips are respectively coated with dedicated structural adhesives, corner assembly connecting is performed.

In the step b), in order to achieve corner sealing tightness, the I-shaped fastening piece is more tightly fastened with the plug notches in the two half corner assemblers by adjusting the fastening bolt.

The disclosure has the characteristics of being simple in structure, convenient to install, firm to use, and capable of effectively ensuring the joining strength of corners and the corner assembly sealing property, increasing convenience of frame assembly and improving the production efficiency.

DETAILED DESCRIPTION OF THE EMBODIMENTS

Figure 1:
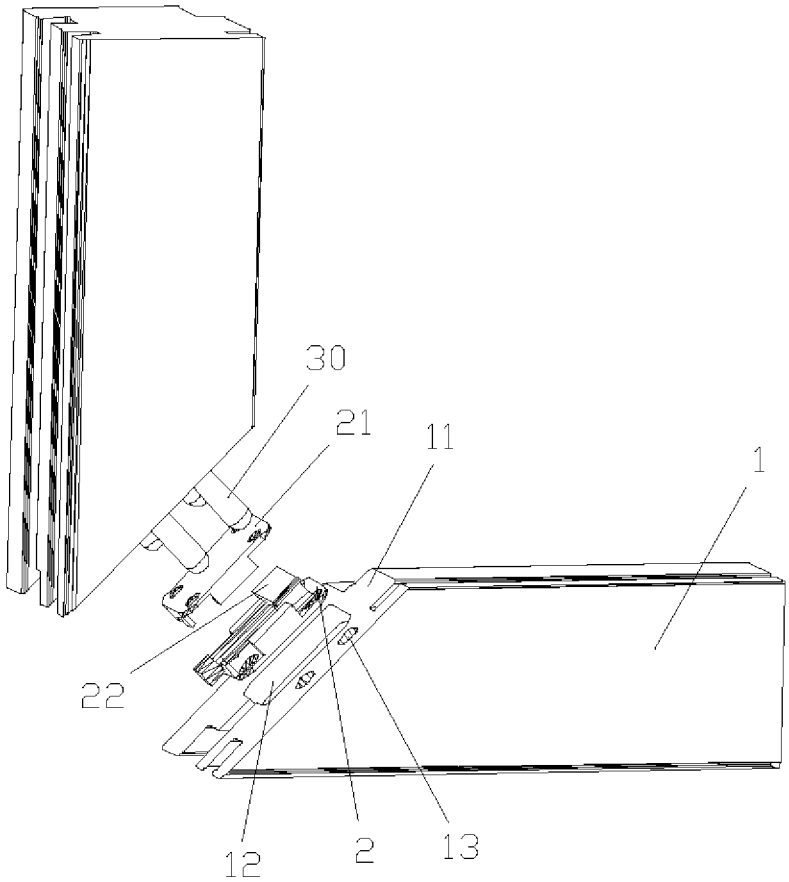
FIG. 1 is a structure diagram of corner assembly of two adjacent profile frame strips according to the disclosure.

The disclosure will be introduced below in conjunction with the drawings in detail. As shown in FIG. 1, according to a frame assembly structure of a wooden doors and windows in the disclosure, the wooden doors and windows comprises, at least, a window frame or a casement window frame mainly formed by connecting adjacent profile frame strips 1 via a corner assembler 2 on adjacent connecting end surfaces. The connecting end surfaces of two adjacent profile frame strips 1 are respectively configured to be cross sections 11 of 0° to 180°. A positioning notch 12 of the corner assembler is at least provided on each of the cross sections 11 of 0° to 180°, and after adjacent profile frame strips 1 are spliced completely, a space for accommodating an assembly-type corner assembler is formed at a spliced joint, wherein a half corner assembler 21 is embedded and fixed into the positioning notch 12 on the cross section 11 of 0° to 180° of a profile frame strip, and the other half corner assembler 21 is embedded and fixed into the positioning notch 12 on the cross section 11 of 0° to 180° of the adjacent profile frame strip. The two half corner assemblers 21 are connected by an I-shaped fastening piece 22 located in an intermediate position of the two half corner assemblers to form a complete assembly-type corner assembler, and tightly and fixedly join the two adjacent profile frame strips 1.

Figure 2:
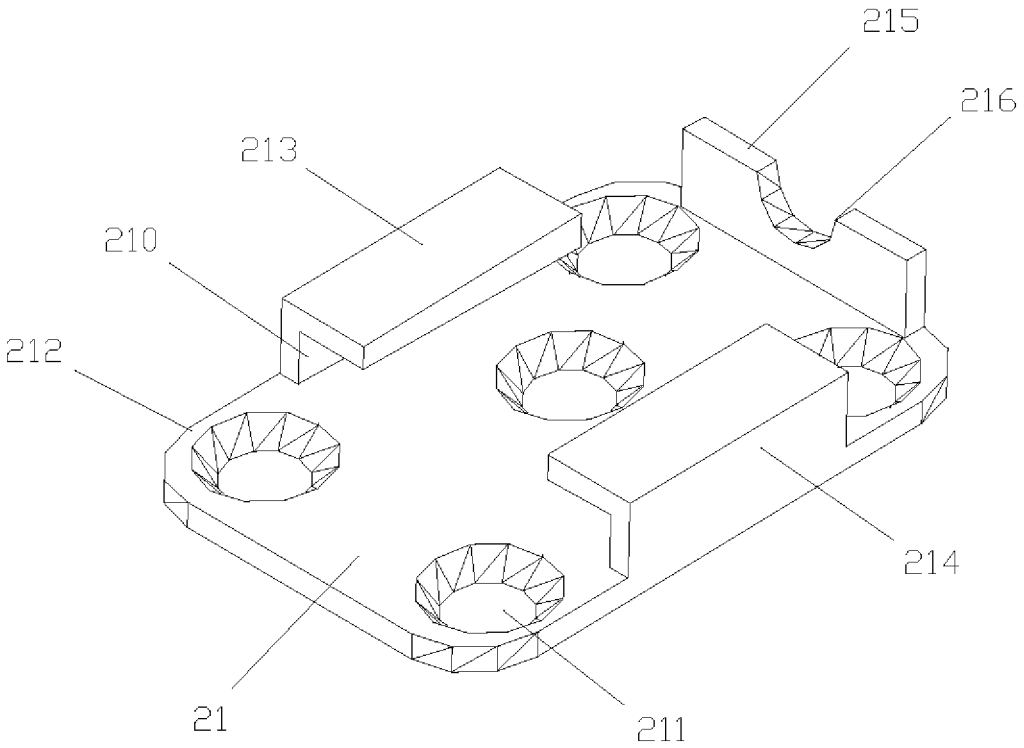
FIG. 2 is a structure diagram of a half corner assembler according to the disclosure.
Figure 3:
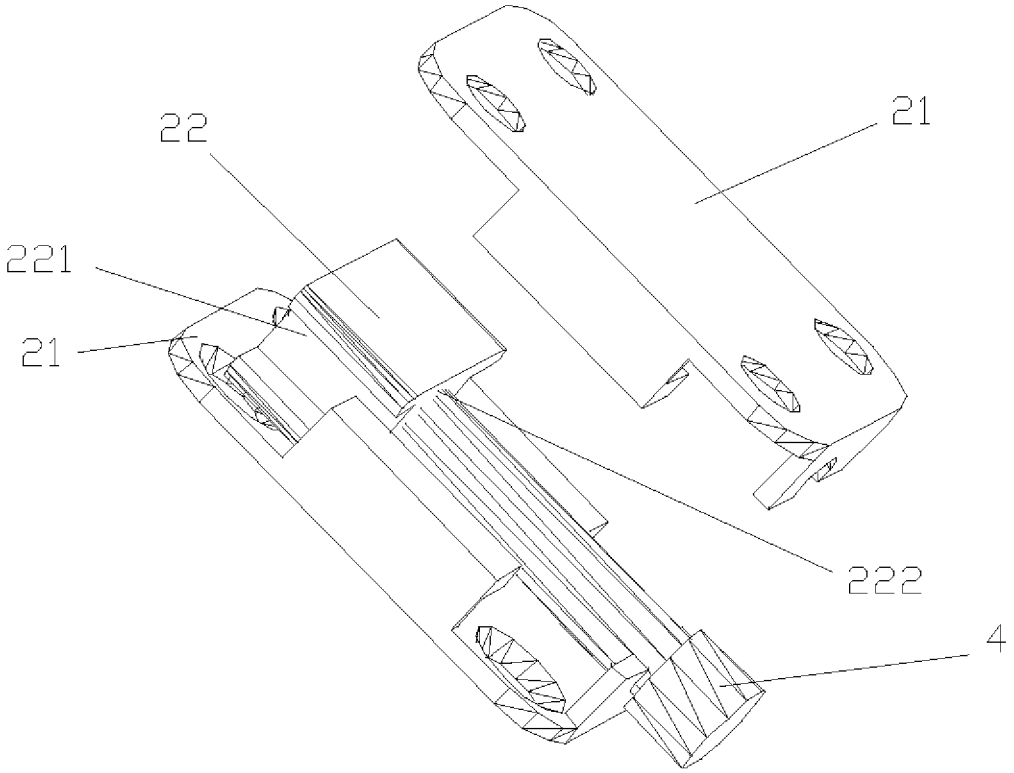
FIG. 3 is an overall structure diagram of an assembly-type corner assembler according to the disclosure.

As shown in FIGS. 2 and 3, the assembly-type corner assembler 2 in the disclosure is formed by combining two half corner assemblers 21 identical in structure and shape, an I-shaped fastening piece 22 and a fastening bolt 4. Each of the half corner assemblers 21 is a fixing substrate 212 with a fixing hole 211, wherein two symmetric side edges of the fixing substrate 212 are vertically provided with a fixing side plate 214 having a buckling edge 213 at an upper end portion, respectively, so as to form a plug notch 210 above the fixing substrate 212. The fastening piece 22 is an I-shaped fastening piece 22, wherein two symmetric edges 221 of the I-shaped fastening piece 22 just correspond to the plug notches 210 on the fixing substrates 212, such that side edges 221 of the I-shaped fastening piece 22 are fixedly connected between the two half corner assemblers 21 after being inserted from an end side.

As shown in the FIG. 2, an end edge of the fixing substrate 212 in the disclosure is provided with one vertical baffle 215, a half-round groove 216 is provided at an upper end of the vertical baffle 215, and a hole allowing the fastening bolt 4 to extend into the assembly-type corner assembler 2 and to screw the I-shaped fastening piece 22 is formed after the two half corner assemblers 21 are connected together. A side end of the I-shaped fastening piece 22 corresponds to the hole is provided with a screw hole 222, the screw hole 222 is used for screwing the fastening bolt 4.

A corner assembly method for a wooden casement window comprises the steps as follows.

a) A profile section needing to be corner-assembled is processed to be a cross section of 0° to 180° according to an angle requirement, and a corner assembly installation groove (positioning notch) and a round tenon rod hole 13 are milled in corner end surfaces of a corresponding profile.

b) Two half corner assemblers 21 are respectively installed in positioning notches at cross sections of 0° to 180° of adjacent profile frame strips, and the half corner assemblers 21 and end surfaces of the profile frame strips are fastened and connected by means of a screw fastening piece.

c) A round tenon rod 30 of one of the profile frame strips is coated with an end surface adhesive, and then the round tenon rod 30 is inserted into the round tenon rod hole 13.

d) During corner assembly, a side edge of an I-shaped fastening piece 22 is inserted into an plug notch 210 of a fixing substrate 212 in a corner assembler of a profile at one side, round tenon rods 30 of two profile frame strips, round tenon rod holes 13 and corner assemblers are calibrated, fastening is performed by means of fastening bolt 4 extending out of holes in vertical baffles of the two half corner assemblers 21 through rotation, and meanwhile, the round tenon rods 30 corresponding to profile corners are positioned and inserted.

The corner assembly method for a wooden doors and windows is provided, in the step a), after the respective cross sections of 0° to 180° of two adjacent profile frame strips are respectively coated with dedicated structural adhesives, corner assembly connecting is performed.

In the step b), in order to achieve corner sealing tightness, the I-shaped fastening piece is more tightly fastened with the plug notches 210 in the two half corner assemblers by adjusting the fastening bolt 4.

A window frame and a casement window are smooth in plane after frame assembly in the disclosure, diagonal errors are small, splicing seams are small, corner assembly strength is high, and the quality of frame assembly is better improved.

Moreover, under the action of tensioning of an I-shaped fastening piece, a sufficient joining tensile force may be provided during use, and the subsequent process may be directly performed without waiting for adhesive solidifying, thereby greatly shortening manufacturing time.

What is claimed is:

1. A frame assembly structure of a wooden doors and windows, the wooden doors and windows comprising, at least, a window frame or a casement window frame formed by joining adjacent profile frame strips via a corner assembler on adjacent connecting end surfaces, wherein the connecting end surfaces of two adjacent profile frame strips are respectively configured to be cross sections of 0° to 180°; a positioning notch of the corner assembler is at least provided on the cross sections of 0° to 180° and after adjacent profile frame strips are spliced completely, a space for accommodating an assembly-type corner assembler is formed at a spliced joint, wherein one half corner assembler is embedded and fixed into the positioning notch on the cross section of 0° to 180° of a profile frame strip, and an additional half corner assembler is embedded and fixed into the positioning notch on the cross section of 0° to 180° of the adjacent profile frame strip; and two half corner assemblers are connected by an I-shaped fastening piece located in an intermediate position of the two half corner assemblers and a fastening bolt to form a complete assembly-type corner assembler, and the two adjacent profile frame strips are connected;

wherein the assembly-type corner assembler is formed by combining the two half corner assemblers identical in structure and shape, the I-shaped fastening piece and a fastening bolt; each of the half corner assemblers is a fixing substrate with a fixing hole, wherein two symmetric side edges of the fixing substrate are vertically provided with a fixing side plate having a buckling edge at an upper end portion, separately, and a plug notch defined by two fixing side plates is provided above the fixing substrate; and the fastening piece is an I-shaped fastening piece, and two symmetric edges of the I-shaped fastening piece just correspond to the plug notches on the fixing substrates, such that side edges of the I-shaped fastening piece are fixedly connected between the two half corner assemblers after being inserted from an end side.

2. The frame assembly structure of a wooden doors and windows as claimed in claim 1, wherein an end edge of the fixing substrate is provided with a vertical baffle, a half-round groove is provided at an upper end of the vertical baffle, and a hole allowing the fastening bolt to extend into the assembly-type corner assembler and to screw the I-shaped fastening piece is formed after the two half corner assemblers are connected together; and a screw hole provided on a side end of the I-shaped fastening piece corresponds to the hole, and the screw hole is used for screwing the fastening bolt.

3. A corner assembly method for a wooden casement window, the corner assembly method assembles the wooden casement window by using the frame assembly structure of a wooden doors and windows as claimed in claim 1, wherein the corner assembly method for the wooden casement window comprises the following steps:

(a) processing a profile section needing to be corner-assembled to be a cross section of 0° to 180°, and milling a positioning notch for mounting a corner assembler and a round tenon rod hole in corner end surfaces of a corresponding profile;

(b) installing two half corner assemblers in positioning notches at cross sections of 0° to 180° of adjacent profile frame strips respectively, and fastening and connecting the half corner assemblers and end surfaces of the profile frame strips by means of a screw fastening piece;

(c) coating a round tenon rod of one of the profile frame strips with an end surface adhesive, and then inserting the round tenon rod into the round tenon rod hole; and (d) during corner assembly, inserting a side edge of an I-shaped fastening piece into a plug notch of a fixing substrate in a corner assembler of a profile at one side, calibrating round tenon rods of two profile frame strips, round tenon rod holes and corner assemblers, fastening by means of fastening bolt extending out of holes in vertical baffles of the two half corner assemblers through rotation, and meanwhile, positioning and inserting the round tenon rods corresponding to profile corners.

4. The corner assembly method for a wooden window as claimed in claim U wherein in the step (a), after the respective cross sections of 0° to 180° of the two adjacent profile frame strips are respectively coated with dedicated structural adhesives, corner assembly connecting is performed; and in the step (b), in order to achieve corner sealing tightness, the I-shaped fastening piece is more tightly fastened with the plug notches in the two half corner assemblers by adjusting the fastening bolt.

* * * * *